US009309587B2

(12) United States Patent
Felkel et al.

(10) Patent No.: US 9,309,587 B2
(45) **Date of Patent: *Apr. 12, 2016**

(54) PLASMA SPRAY NOZZLE WITH INTERNAL INJECTION

(71) Applicant: SIEMENS AKTIENGESELLSCHAFT, München (DE)

(72) Inventors: Mario Felkel, Berlin (DE); Heiko Gruner, Mägenwil (CH); Francis Ladru, Berlin (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 66 days.

This patent is subject to a terminal disclaimer.

(21) Appl. No.: 13/960,868

(22) Filed: Aug. 7, 2013

(65) Prior Publication Data

US 2013/0334176 A1 Dec. 19, 2013

Related U.S. Application Data

(63) Continuation of application No. 12/938,657, filed on Nov. 3, 2010, now Pat. No. 8,528,835.

(30) Foreign Application Priority Data

Nov. 4, 2009 (EP) ..... 09013864

(51) Int. Cl.

| | |
|---|---|
| ***H05H 1/34*** | (2006.01) |
| ***H05H 1/42*** | (2006.01) |
| ***B05B 7/22*** | (2006.01) |
| ***C23C 4/12*** | (2006.01) |

(52) U.S. Cl.

CPC ..... *C23C 4/127* (2013.01); *B05B 7/226* (2013.01); *H05H 1/42* (2013.01); *H05H 2001/3484* (2013.01)

(58) Field of Classification Search

CPC ... H05H 1/34; H05H 1/42; H05H 2001/3478; H05H 2001/3484; B05B 7/226; C23C 4/127; C23C 24/04

See application file for complete search history.

(56) References Cited

U.S. PATENT DOCUMENTS

| | | | | |
|---|---|---|---|---|
| 3,803,380 | A | | 4/1974 | Ragaller |
| 5,271,965 | A | * | 12/1993 | Browning ..... 427/446 |
| 5,405,085 | A | | 4/1995 | White |
| 5,518,178 | A | * | 5/1996 | Sahoo et al. ..... 239/13 |
| 5,637,242 | A | | 6/1997 | Muehlberger |
| 5,837,959 | A | | 11/1998 | Muehlberger |
| 5,858,470 | A | | 1/1999 | Bernecki |
| 6,003,788 | A | * | 12/1999 | Sedov ..... 239/397.5 |
| 6,024,792 | A | | 2/2000 | Bieler |
| 6,114,649 | A | | 9/2000 | Delcea |

(Continued)

FOREIGN PATENT DOCUMENTS

| | | | |
|---|---|---|---|
| CN | 101167412 | A | 4/2008 |
| EP | 0486489 | B1 | 11/1994 |

(Continued)

*Primary Examiner* — Darren W Gorman

(57) ABSTRACT

A plasma spray nozzle is provided. Owing to their high degree of wear, previous plasma spray nozzles were not suitable for the coating of components for which long coating times were necessary. The coating times may be reduced considerably by the triple injection of powder into the inner channel through the plasma spray nozzle.

16 Claims, 2 Drawing Sheets

(56) References Cited

U.S. PATENT DOCUMENTS

| | | | |
|---|---|---|---|
| 6,137,078 | A | 10/2000 | Keller |
| 6,322,856 | B1 | 11/2001 | Hislop |
| 2001/0041227 | A1 | 11/2001 | Hislop |
| 2008/0057212 | A1 | 3/2008 | Barbezat |

FOREIGN PATENT DOCUMENTS

| | | | |
|---|---|---|---|
| EP | 0766502 | A1 | 4/1997 |
| EP | 0412397 | B1 | 3/1998 |
| EP | 0892090 | A1 | 1/1999 |
| EP | 0786017 | B1 | 3/1999 |
| EP | 1306454 | A1 | 5/2003 |
| EP | 1319729 | A1 | 6/2003 |
| EP | 1204776 01 | | 6/2004 |
| WO | WO 9604098 | A1 | 2/1996 |
| WO | WO 9814634 | A1 | 4/1998 |
| WO | WO 9967435 | A1 | 12/1999 |
| WO | WO 0044949 | A1 | 8/2000 |
| WO | WO 2007065252 | A1 | 6/2007 |
| WO | WO 2008101226 | A1 | 8/2008 |
| WO | WO 2008131605 | A1 | 11/2008 |

* cited by examiner

PLASMA SPRAY NOZZLE WITH INTERNAL INJECTION

CROSS REFERENCE TO RELATED APPLICATIONS

This application is a continuation of U.S. Ser. No. 12/938,657 filed on Nov. 3, 2010 which claims priority of European Patent Office application No. 09013864.5 EP filed Nov. 4, 2009, which is incorporated by reference herein in its entirety.

FIELD OF INVENTION

The invention relates to a plasma spray nozzle, wherein the powder is injected.

BACKGROUND OF INVENTION

In order to increase the efficiency of the turbine, it is necessary to facilitate high temperatures at the turbine intake. This is achieved by applying a metallic and ceramic coating onto the turbine blade, the thickness of this coating being up to 800 micrometers.

The process has to date proven very inefficient because the coating operation lasts more than 70 minutes. The reason is that such long coating times cause the spray spot to vary because of wear to the nozzle, so that the spraying result varies over time. This is undesirable.

SUMMARY OF INVENTION

It is therefore an object of the invention to resolve the aforementioned problem.

The object is achieved by a plasma spray nozzle as claimed in the claims.

Further advantageous measures are listed in the dependent claims, and these may be combined in a variety of ways in order to achieve further advantages.

The description and the figures only represent exemplary embodiments of the invention.

DETAILED DESCRIPTION OF INVENTION

Figure 1:
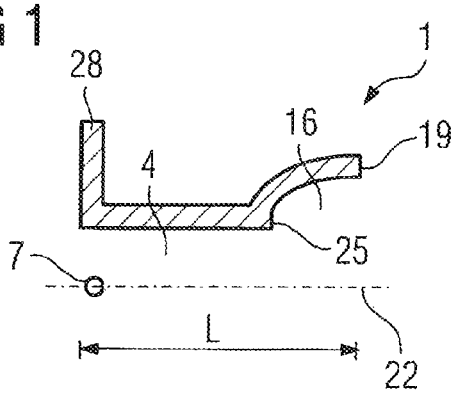
FIGS. 1, 4, 5 show plasma spray nozzles in longitudinal section.

FIG. 1 shows a plasma spray nozzle 1 in longitudinal section.

The plasma spray nozzle 1 has, on its inside, an elongate inner channel 4 with a longitudinal axis 22, in which 4 a plasma is generated and into which 4 powder is injected through at least one hole 7.

The inner channel 4 is formed so that it is longer than the divergent region 16, and in particular comprises 60%, more particularly 75%, of the total length.

There is a divergent part 16 at the end 19 of the plasma spray nozzle 1, so that the inner cross section of the inner channel 4 increases toward the exit or end 19.

The outer diameter of the end 28 of the nozzle 1, which lies opposite the divergent part 16, is preferably more than the outer diameter at the end 19 of the divergent region 16. This means that the mass per axial length is greater at the end 28.

Figure 2:
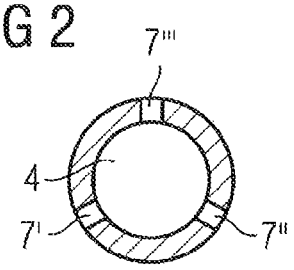
FIGS. 2, 3, 6 show plasma spray nozzles in cross section.
Figure 3:
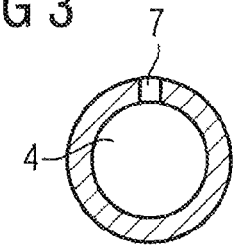

The powder injection is carried out internally, i.e. before the divergent region 16. It may take place through one hole 7 (FIG. 3) or through several holes 7', 7", 7'" (FIG. 2).

The distance between the at least one hole 7, 7', 7", 7'" and the end 19 of the nozzle 1 is preferably at least 60%, in particular at least 70%, more particularly 80% of the total length L of the nozzle 1.

At the start of the divergent part 16, there is preferably a shoulder 25 (FIG. 1, 4) which guides the electric arc of the plasma toward the inner channel 4.

The shoulder 25 constitutes a non-constant or discontinuous transition 25 to the divergent region 16.

There is preferably an edge at the transition 25 from the inner channel 4 with a constant cross section to the divergent region 16.

The shoulder 25 preferably extends perpendicularly to the longitudinal axis 22 of the inner channel 4.

Figure 5:
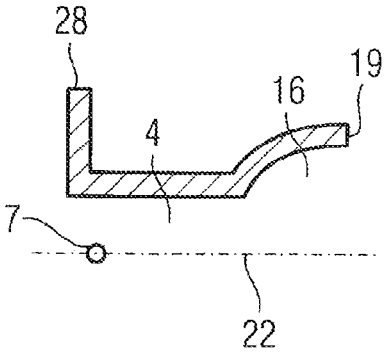
Figure 6:
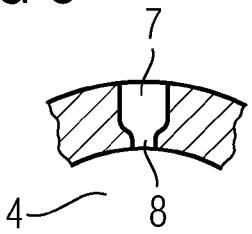

It is also possible for there to be no shoulder 25 (FIG. 5).

Figure 4:
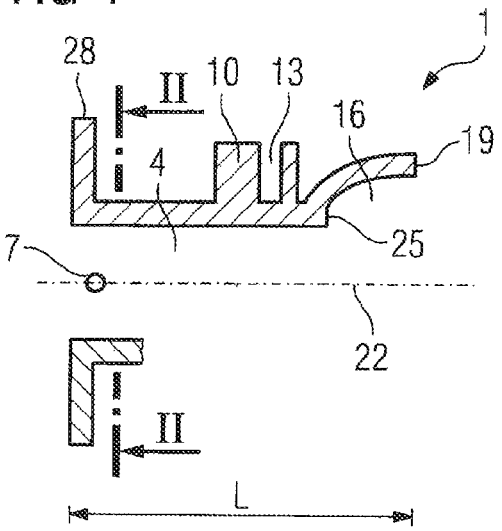

Cooling fins 10 are preferably provided externally along the flow direction for the plasma spray nozzle 1, that is to say parallel to the longitudinal axis 22 of the nozzle 1 or of the channel 4 (FIG. 4).

The outer diameter of these 10 may exceed the outer diameter at the end 19 of the divergent region 16.

A sealing ring 13 is preferably arranged between the cooling fins 10 (FIG. 4).

FIG. 2 shows another exemplary embodiment.

The powder is delivered into the channel 4 of the plasma spray nozzle 1 not through one, but in particular through two holes, particularly through three holes 7, 7', 7", which are preferably distributed uniformly around the circumference of the inner channel 4.

Owing to this arrangement of triple injection, the injection of the powder can be controlled accurately in relation to the jet, and the pass spacing, i.e. the spacing between runs over the component to be coated, can be at least doubled, the spray spot being kept constant in the same position so that the coating time is reduced significantly. Except for the inner channel 4 and the powder injection holes 7, 7', 7", 7'", the nozzle 1 is formed solidly.

The at least one hole 7 has a taper 8 at the end, i.e. close to where it enters the inner channel 4, in order to inject into the plasma jet in a controlled way.

Figure 7:
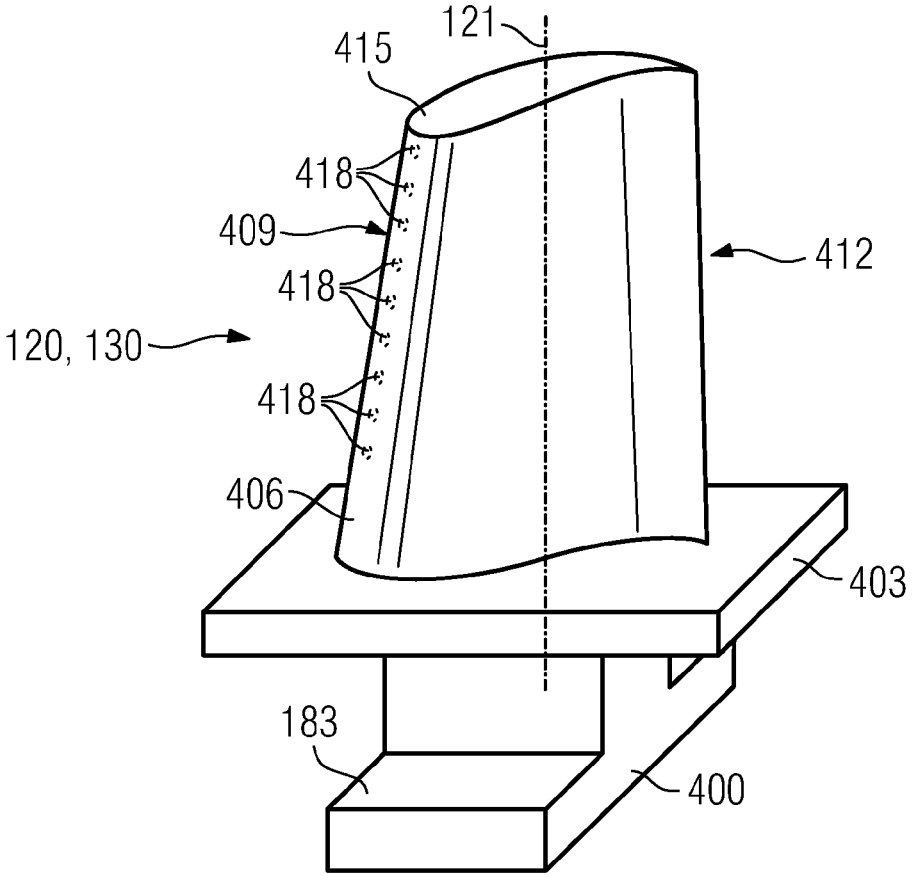
FIG. 7 shows a turbine blade.

FIG. 7 shows a perspective view of a rotor blade 120 or guide vane 130 of a turbomachine, which extends along a longitudinal axis 121.

The turbomachine may be a gas turbine of an aircraft or of a power plant for electricity generation, a steam turbine or a compressor.

The blade 120, 130 comprises, successively along the longitudinal axis 121, a fastening zone 400, a blade platform 403 adjacent thereto as well as a blade surface 406 and a blade tip 415.

As a guide vane 130, the vane 130 may have a further platform (not shown) at its vane tip 415.

A blade root 183 which is used to fasten the rotor blades 120, 130 on a shaft or a disk (not shown) is formed in the fastening zone 400.

The blade root 183 is configured, for example, as a hammerhead. Other configurations such as a firtree or dovetail root are possible.

The blade 120, 130 comprises a leading edge 409 and a trailing edge 412 for a medium which flows past the blade surface 406.

In conventional blades 120, 130, for example solid metallic materials, in particular superalloys, are used in all regions 400, 403, 406 of the blade 120, 130.

Such superalloys are known for example from EP 1 204 776 B1, EP 1 306 454, EP 1 319 729 A1, WO 99/67435 or WO 00/44949.

The blade 120, 130 may in this case be manufactured by a casting method, also by means of directional solidification, by a forging method, by a machining method or combinations thereof.

Workpieces with a single-crystal structure or single-crystal structures are used as components for machines which are exposed to heavy mechanical, thermal and/or chemical loads during operation.

Such single-crystal workpieces are manufactured, for example, by directional solidification from the melts. These are casting methods in which the liquid metal alloy is solidified to form a single-crystal structure, i.e. to form the single-crystal workpiece, or is directionally solidified.

Dendritic crystals are in this case aligned along the heat flux and form either a rod crystalline grain structure (columnar, i.e. grains which extend over the entire length of the workpiece and in this case, according to general terminology usage, are referred to as directionally solidified) or a single-crystal structure, i.e. the entire workpiece consists of a single crystal. It is necessary to avoid the transition to globulitic (polycrystalline) solidification in these methods, since non-directional growth will necessarily form transverse and longitudinal grain boundaries which negate the beneficial properties of the directionally solidified or single-crystal component.

When directionally solidified structures are referred to in general, this is intended to mean both single crystals which have no grain boundaries or at most small-angle grain boundaries, and also rod crystal structures which, although they do have grain boundaries extending in the longitudinal direction, do not have any transverse grain boundaries. These latter crystalline structures are also referred to as directionally solidified structures.

Such methods are known from U.S. Pat. No. 6,024,792 and EP 0 892 090 A1.

The blades 120, 130 may also have coatings against corrosion or oxidation, for example MCrAlX (M is at least one element from the group iron (Fe), cobalt (Co), nickel (Ni), X is an active element and stands for yttrium (Y) and/or silicon and/or at least one rare earth element, or hafnium (Hf)). Such alloys are known from EP 0 486 489 B1, EP 0 786 017 B1, EP 0 412 397 B1 or EP 1 306 454 A1.

The density is preferably 95% of the theoretical density.

A protective aluminum oxide layer (TGO=thermally grown oxide layer) is formed on the MCrAlX coating (as an interlayer or as the outermost coat).

The coating composition preferably comprises Co-30Ni-28Cr-8Al-0.6Y-0.7Si or Co-28Ni-24Cr-10Al-0.6Y. Besides these cobalt-based protective coatings, it is also preferable to use nickel-based protective coatings such as Ni-10Cr-12Al-0.6Y-3Re or Ni-12Co-21Cr-11Al-0.4Y-2Re or Ni-25Co-17Cr-10Al-0.4Y-1.5Re.

On the MCrAlX, there may furthermore be a thermal barrier coating, which is preferably the outermost coat and consists for example of $ZrO_2$, $Y_2O_3$—$ZrO_2$, i.e. it is not stabilized or is partially or fully stabilized by yttrium oxide and/or calcium oxide and/or magnesium oxide.

The thermal barrier coating covers the entire MCrAlX coating.

Rod-shaped grains are produced in the thermal barrier coating by suitable coating methods, for example electron beam deposition (EB-PVD).

Other coating methods may be envisaged, for example atmospheric plasma spraying (APS), LPPS, VPS or CDV. The thermal barrier coating may comprise porous, micro- or macro-cracked grains for better thermal shock resistance. The thermal barrier coating is thus preferably more porous than the MCrAlX coating.

Refurbishment means that components 120, 130 may need to be stripped of protective coatings (for example by sandblasting) after their use. The corrosion and/or oxidation layers or products are then removed. Optionally, cracks in the component 120, 130 are also repaired. The component 120, 130 is then recoated and the component 120, 130 is used again.

The blade 120, 130 may be designed to be hollow or solid. If the blade 120, 130 is intended to be cooled, it will be hollow and optionally also comprise film cooling holes 418 (indicated by dashes).

We claim:

1. A plasma spray nozzle, comprising:

an inner channel including a first end and a second end which is downstream from the first end; and a powder injection hole, wherein the inner channel includes a divergent region at the second end, and wherein the powder injection hole is not arranged in the divergent region, wherein the inner channel consists of the divergent region and a region with a constant cross section, wherein the divergent region includes a first end which is disposed where in the inner channel starts to diverge and a second end which coincides with the second end of the inner channel, wherein the plasma spray nozzle includes a shoulder at the first end of the divergent region configured to guide plasma toward the inner channel, wherein the powder injection hole is arranged close to the first end of the inner channel opposite from the divergent region, and wherein a first outer diameter of the plasma spray nozzle at the second end of the divergent region is less than a second outer diameter at the first end of the inner channel.

2. The plasma spray nozzle as claimed in claim 1, wherein the plasma spray nozzle includes at least two powder injection holes.

3. The plasma spray nozzle as claimed in claim 2, wherein the plasma spray nozzle includes at least three powder injection holes.

4. The plasma spray nozzle as claimed in claim 1, wherein the plasma spray nozzle includes a plurality of external cooling fins.

5. The plasma spray nozzle as claimed in claim 4, wherein the plurality of external cooling fins are arranged between the divergent region and the powder injection hole.

6. The plasma spray nozzle as claimed in claim 4, wherein the plasma spray nozzle includes an external sealing ring.

7. The plasma spray nozzle as claimed in claim 6, wherein the external sealing ring is arranged between the plurality of cooling fins.

8. The plasma spray nozzle as claimed in claim 1, wherein an axial distance between the powder injection hole and the second end of the divergent region is at least 60% of a total length of the plasma spray nozzle.

9. The plasma spray nozzle as claimed in claim 1, wherein an axial distance between the powder injection hole and the second end of the divergent region is 70% of the total length of the plasma spray nozzle.

10. The plasma spray nozzle as claimed in claim 1, wherein an axial distance between the powder injection hole and the second end of the divergent region is 80% of the total length of the plasma spray nozzle.

11. The plasma spray nozzle as claimed in claim 1, wherein the powder injection hole includes a taper at an end of the powder injection hole which enters the inner channel.

12. The plasma spray nozzle as claimed in claim 1, wherein the inner channel is formed radially symmetric.

13. The plasma spray nozzle as claimed in claim 1, wherein the region with a constant cross section of the inner channel is longer than the divergent region.

14. The plasma spray nozzle as claimed in claim 13, wherein the region with a constant cross section of the inner channel is 60% of the total length of the plasma spray nozzle.

15. The plasma spray nozzle as claimed in claim 13, wherein the region with a constant cross section of the inner channel is 75% of the total length of the plasma spray nozzle.

16. The plasma spray nozzle as claimed in claim 1, wherein the divergent region is radially symmetric.

* * * * *